US010882212B2

(12) United States Patent
Scardovi et al.

(10) Patent No.: US 10,882,212 B2
(45) Date of Patent: Jan. 5, 2021

(54) METHOD AND PLANT FOR MANUFACTURING CERAMIC PRODUCTS

(71) Applicant: SACMI COOPERATIVA MECCANICI IMOLA SOCIETA' COOPERATIVA, Imola (IT)

(72) Inventors: Stefano Scardovi, Imola (IT); Claudio Ricci, Imola (IT); Giovanni Lancieri, Imola (IT); Gildo Bosi, Imola (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 251 days.

(21) Appl. No.: 16/026,961

(22) Filed: Jul. 3, 2018

(65) Prior Publication Data

US 2019/0009430 A1 Jan. 10, 2019

(30) Foreign Application Priority Data

Jul. 5, 2017 (IT) ..... 10201775495

(51) Int. Cl.
*B28B 13/02* (2006.01)
*B28B 17/00* (2006.01)
(Continued)

(52) U.S. Cl.
CPC ..... *B28B 13/0225* (2013.01); *B28B 1/005* (2013.01); *B28B 3/00* (2013.01);
(Continued)

(58) Field of Classification Search
CPC ..... B28B 13/0225; B28B 1/005; B28B 3/00; B28B 3/123; B28B 11/001; B28B 11/048; B28B 13/022; B28B 17/0081; B28B 2005/045; B41J 3/407; B41M 5/0041; B41M 5/007; E04F 15/08
(Continued)

(56) References Cited

U.S. PATENT DOCUMENTS

2014/0017452 A1* 1/2014 Pervan ..... E04F 15/042 428/172

FOREIGN PATENT DOCUMENTS

EP 1787779 5/2007
WO 2005068146 7/2005
(Continued)

OTHER PUBLICATIONS

Search Report for Application No. IT 201700075495 dated Mar. 12, 2018.

*Primary Examiner* — Joseph S Del Sole
*Assistant Examiner* — Lawrence D. Hohenbrink, Jr.
(74) *Attorney, Agent, or Firm* — Workman Nydegger

(57) ABSTRACT

A method and a plant (i.e., system or assembly) for manufacturing ceramic products comprising the steps of feeding a mixture of ceramic powders so as to obtain a powder material strip; compacting the powder material strip so as to obtain a compacted powder layer; acquiring a surface image of the compacted powder layer that reproduces the respective surface chromatic effects; processing said surface image so as to obtain a graphic decoration to be applied on the surface of the compacted powder layer that is coordinated with the respective chromatic effects in the thickness; and printing the graphic decoration on the surface of the compacted powder layer.

11 Claims, 5 Drawing Sheets

(51) Int. Cl.

| | |
|---|---|
| ***B28B 11/00*** | (2006.01) |
| ***B41J 3/407*** | (2006.01) |
| ***B28B 3/12*** | (2006.01) |
| ***B28B 11/04*** | (2006.01) |
| ***B28B 1/00*** | (2006.01) |
| ***B28B 3/00*** | (2006.01) |
| *B41M 5/00* | (2006.01) |
| *E04F 15/08* | (2006.01) |
| *B28B 5/04* | (2006.01) |

(52) U.S. Cl.
CPC ..... *B28B 3/123* (2013.01); *B28B 11/001* (2013.01); *B28B 11/048* (2013.01); *B28B 13/022* (2013.01); *B28B 17/0081* (2013.01); *B41J 3/407* (2013.01); *B28B 2005/045* (2013.01); *B41M 5/007* (2013.01); *B41M 5/0041* (2013.01); *E04F 15/08* (2013.01)

(58) Field of Classification Search
USPC ..... 427/510; 425/145
See application file for complete search history.

(56) References Cited

FOREIGN PATENT DOCUMENTS

| | | | | |
|---|---|---|---|---|
| WO | WO-2005068146 A2 * | 7/2005 | ..... | B28B 3/10 |
| WO | 2017021825 | 2/2017 | | |

* cited by examiner

METHOD AND PLANT FOR MANUFACTURING CERAMIC PRODUCTS

CROSS-REFERENCE TO RELATED APPLICATIONS

The present invention claims priority from Italian Patent Application no. 102017000075495, filed Jul. 5, 2017, the entire content of which is incorporated by reference herein.

BACKGROUND OF THE INVENTION

1. The Field of the Invention

The present invention relates to a method and to a manufacturing plant (i.e., systems, assemblies) for manufacturing ceramic products.

2. Background and Relevant Art

In recent years plants (i.e., systems or assemblies) for manufacturing ceramic products, such as slabs or tiles, capable of reproducing, as faithfully as possible, the patterns typical of natural stone, such as marble and/or granite, have become increasingly widespread. In fact, as is known, natural stone has internal streaks or veins distributed randomly throughout its thickness.

Typically, ceramic products of the type described above are manufactured in plants that comprise feeding devices for ceramic powders of different types to be fed to machines for pressing said ceramic powders.

More in detail, a plant of known type comprises a conveyor assembly for transferring in a substantially continuous manner the powder material from an input station to the pressing unit and, subsequently, for transferring a compacted powder layer output from the pressing unit towards further processing stations.

A feeding assembly is arranged upstream of the pressing unit at the input station and comprises a number of metering devices of ceramic powders having different features and/or colours from one another for creating a continuous powder material strip on the conveyor belt. The feeding assembly is produced so as to create a mixture of ceramic powders having chromatic effects for the entire thickness that reproduces the patterns of natural stone and are visible both on the surface and on the edges of the finished ceramic products. An example of a continuous machine for compacting ceramic powder is described in the international patent application published with the number WO2005/068146 by the same applicant of the present application.

The pressing unit of a known type comprises a lower compacting belt arranged below and in contact with the conveyor assembly that cooperates with an upper compacting belt for the dry compaction of the ceramic powder strips and for obtaining the compacted powder layer.

The plant also comprises a cutting device, arranged downstream of the pressing unit, to make the transverse cut of the compacted ceramic powder layer so as to obtain slabs and, preferably, to trim the lateral edges of the slabs and optionally divide the slab into two or more longitudinal portions.

The slabs are then fed by the cutting device to a dryer arranged downstream of the pressing unit and subsequently to a digital printing device arranged downstream of the dryer, which is adapted to create a graphic decoration randomly on top of the compacted ceramic powder layer. In this way the finished article is made more visually similar to a natural product.

In particular, the printing device is connected to a processing unit inside which an archive of reference images is stored, each of which reproduces a combination of different chromatic effects (such as veins and stratifications) from one another that are reproduced randomly on the slabs.

Finally, the plant comprises at least one firing kiln arranged downstream of the printing unit for sintering the compacted powder layer of the slabs so as to obtain the finished ceramic products.

However, the plants described above have the drawback that distribution of the powders takes place randomly and, that the choice of the reference image to be reproduced on the compacted ceramic powder layer of the slabs is also random. Therefore, very often the chromatic effects that are created in the thickness of the ceramic products that are visible observing the edge of the products are not in a coordinated position with respect to the surface chromatic effects obtained by means of digital printing. The lack of synchronization between the chromatic effects obtained in the thickness and the surface chromatic effects significantly compromises the appearance of the ceramic product, making the difference from the natural product much more noticeable.

Therefore, the object of the present invention is to provide a method for manufacturing ceramic products that overcomes the drawbacks of the state of the art while at the same time being easy and inexpensive to implement.

A further object of the present invention is to provide a plant for manufacturing ceramic products that overcomes the drawbacks of the state of the art while at the same time being easy and inexpensive to produce.

BRIEF SUMMARY OF THE INVENTION

According to the present invention a method and a plant (i.e., system or assembly) are provided for manufacturing ceramic products as set forth in the appended claims.

BRIEF DESCRIPTION OF THE DRAWINGS

The invention is described below with reference to the accompanying drawings, which illustrate some non-limiting examples of embodiment thereof, wherein.

DETAILED DESCRIPTION OF THE PREFERRED EMBODIMENTS

Figure 1:
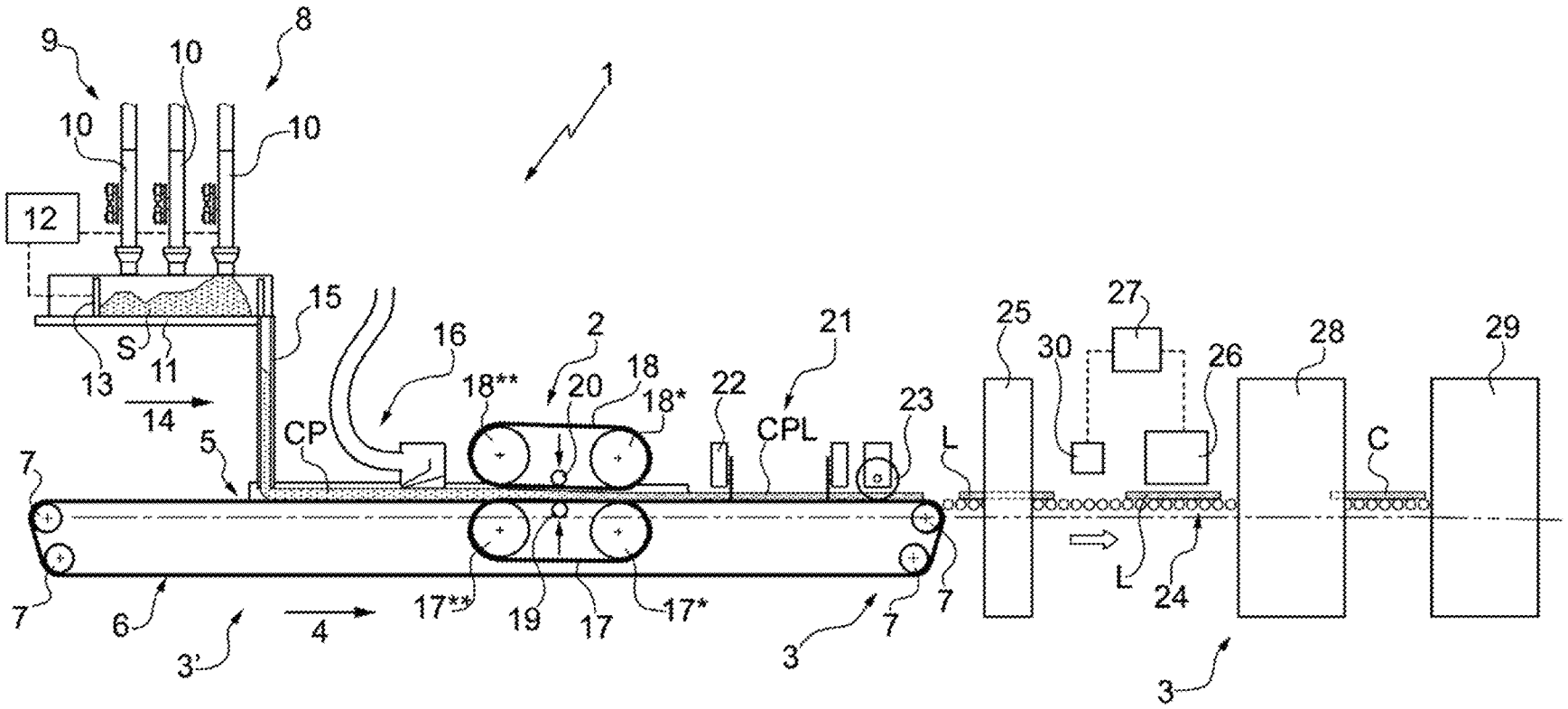
FIG. 1 is a schematic side view of a plant (i.e., system or assembly) for manufacturing ceramic products implemented in accordance with the present invention.

In FIG. 1, a plant (i.e., system or assembly) for manufacturing ceramic products C, such as ceramic tiles or slabs, is indicated as a whole with the reference numeral 1.

The plant 1 comprises a pressing unit 2 created to compact a continuous powder material strip CP, comprising ceramic powder, so as to obtain a compacted powder layer CPL. The plant 1 comprises a conveyor assembly 3 for transferring in a substantially continuous manner in a feed direction 4 the powder material CP from an input station 5 to the pressing unit 2 and, subsequently, for transferring the compacted powder layer CPL from the pressing unit 2 towards further processing stations, as better described below. The conveyor assembly 3 is preferably produced in a stretch 3' by means of a conveyor belt 6 wrapped in a closed loop around the pulleys 7.

The plant 1 is also provided with a feeding assembly 8 of the powder material CP arranged upstream of the pressing unit 2. The feeding assembly 8 comprises a feeding device 9 of a mixture of ceramic powders (in particular, arranged above the conveyor assembly 3) for creating the continuous powder material strip on the conveyor belt 6. The feeding device 9 comprises a plurality of metering elements 10 of respective powders having different features and/or colours from one another. According to the specific and non-limiting embodiment illustrated in FIG. 1, the feeding device 9 comprises metering elements 10 arranged side by side that deposit the powders inside a collection chamber S on a collection surface 11. The metering elements 10 receive the powders through respective feeding systems (not illustrated) of atomized powders comprising hoppers and/or tubes and are provided with respective shut-off valves to adjust the flow of powders and arranged at the output mouths of the respective metering elements 10. The powders of the metering elements 10 are deposited on the collection surface 11 randomly or according to a predefined pattern. In particular, the plant 1 comprises a control unit 12 connected to the shut-off valves and arranged to adjust the succession and the opening and closing times of the shut-off valves so as to create chromatic effects in the thickness of the continuous powder material strip CP (and, consequently, in the thickness of the ceramic products C) that reproduce the veins and stratifications of natural stone, such as marble and/or granite, and that are subsequently visible both on the surfaces and on the edges of the same ceramic products C. Alternatively or in addition, the powder materials are adapted to provide the ceramic products C with different physical features.

The metering elements 10 can alternatively be fixed or mobile on guides in a direction orthogonal to the feed direction 4; the choice of mobile metering elements 10 is preferable in the case in which one wishes to reproduce the chromatic effects of natural stone, such as marble and/or granite. In the case of mobile metering elements 10, the control unit 12 is arranged also to control the sequence of transverse movements of the metering elements 10 and to coordinate them with the opening and closing times of the respective shut-off valves.

The collection surface 11 is arranged substantially parallel to an upper branch of the conveyor belt 6 and is connected to two lateral partitions for holding the powders. Moreover, the feeding assembly 8 comprises a mobile member 13 that moves along the direction 14 substantially parallel to the feed direction 4.

The moving member 13 is connected to the control unit 12 that controls the movement between a rearward position and a forward position to vary the volume of the collection chamber C, and vice versa. In particular, the member 13 is maintained in the rearward position while the metering elements 10 pour the respective ceramic powders onto the collection surface 11 reproducing the desired chromatic effects. Subsequently, the control unit 12 controls the movement of the mobile member 13 that, starting from the rearward position, moves until reaching the forward position pushing the powders arranged on the collection surface 11 into the loading opening of a vertical hopper 15 that deposits the powders at the input station 5 of the conveyor belt 6 through an output mouth with longitudinal extension transverse (in particular, perpendicular) to the feed direction 4; subsequently, the member 13 returns to the rearward position to allow the collection chamber S to be filled again.

According to some specific and non-limiting embodiments, the feeding assembly 8 is of the type described in the patent application WO2005068146, from which further details of the feeding device 9 can be obtained.

Alternatively, in some specific non-limiting cases, the feeding assembly 8 is as described in the patent application published with the number EP1787779.

Advantageously, but not necessarily, the plant 1 is also provided with a suction scraping system 16 of known type (not described in detail) interposed between the feeding assembly 8 and the pressing unit 2 and produced to make the continuous powder material strip CP uniform and remove excess powders.

According to some non-limiting embodiments, the pressing unit 2 comprises a lower compactor belt 17 arranged below and in contact with the conveyor belt 6 and that cooperates with an upper compactor belt 18 for the dry compaction of the continuous powder material strip CP and obtain the compacted powder layer CPL. The upper compactor belt 18 is preferably inclined with respect to the conveyor belt 6 towards which it converges in the feed direction 4 to gradually increase the pressure on the continuous powder material strip CP. The upper compactor belt 18 is wrapped around a front drive roller 18* and a rear driven roller 18; similarly, the lower compactor belt 17 is wrapped around a front drive roller 17* and a rear driven roller 17****.

More precisely, both the lower compactor belt 17 and the upper compactor belt 18 are provided with respective compaction rollers (or assemblies of compaction rollers), indicated respectively with 19 and 20, arranged in a central area of the respective compactor belts 17, 18.

In particular, the plant 1 also comprises a cutting device 21, arranged downstream of the pressing unit 2 to make the transverse cut of the compacted powder layer CPL so as to obtain slabs L. The cutting device 21 comprises at least a cutting blade 22, which is adapted to come into contact with the compacted powder layer CPL to cut it transversely.

According to a preferred but non-limiting embodiment, the cutting device 21 also comprises at least two further rotating knives 23 (only one of which is illustrated in FIG. 1), which are arranged on opposite sides of the conveyor belt 6 and are designed to trim the lateral edges of the slabs L and optionally to divide the slab L into two or more longitudinal portions.

Advantageously but not necessarily, the conveyor assembly 3 is produced in a stretch 3" by means of a roller conveyor 24 that receives the slabs L from the cutting device 21 and feeds them to a dryer 25 arranged downstream of the pressing unit 2.

The plant 1 further comprises a printing device 26, which is adapted to create a graphic decoration on a surface of the compacted powder layer CPL.

According to alternative embodiments, the dryer can be arranged upstream or downstream of the printing device 26 along the roller conveyor 24.

According to some non-limiting embodiments (such as the one illustrated), the printing device 26 is adapted to create a graphic decoration on a surface of the compacted powder layer CPL when the compacted powder layer CPL has already been cut transversely and the slabs L have been obtained. In other words, the printing device 26 is adapted to create a graphic decoration on the surface of each slab L.

The plant 1 also comprises a processing unit 27 which is connected to the printing device 26 designed to create the graphic decoration on the slabs L. In particular, the processing unit 27 is adapted to create a graphic decoration that is coordinated with the chromatic effects obtained in the thickness of the slabs L that reproduce the veins and the stratifications of natural stone so as to make the finished ceramic product C more visually similar to a natural product. In particular, as better described below, the processing unit 27 is configured to acquire a surface image I of each slab L that reproduces the respective surface chromatic effects; to subsequently process the surface image I so as to obtain a graphic decoration to be applied on the surface of the slab L that is coordinated with the respective chromatic effects in the thickness; and finally to control the printing device 26 that creates the print of the graphic decoration on the surface of the slab L (as a function of the graphic decoration to be applied obtained).

Finally, the plant 1 comprises at least a firing kiln 28 arranged downstream of the printing device 26 to sinter the compacted powder of the slabs L so as to obtain the ceramic products C.

According to a non-limiting embodiment, the plant 1 comprises a further cutting device 29, arranged downstream of the firing kiln 28 to produce a further finish of the ceramic products C. It must be noted that, alternatively or in addition, it is possible to carry out further cuts of the ceramic products C on site during their final installation (for example to produce a hole, inside which a sink is to be installed).

Figure 2:
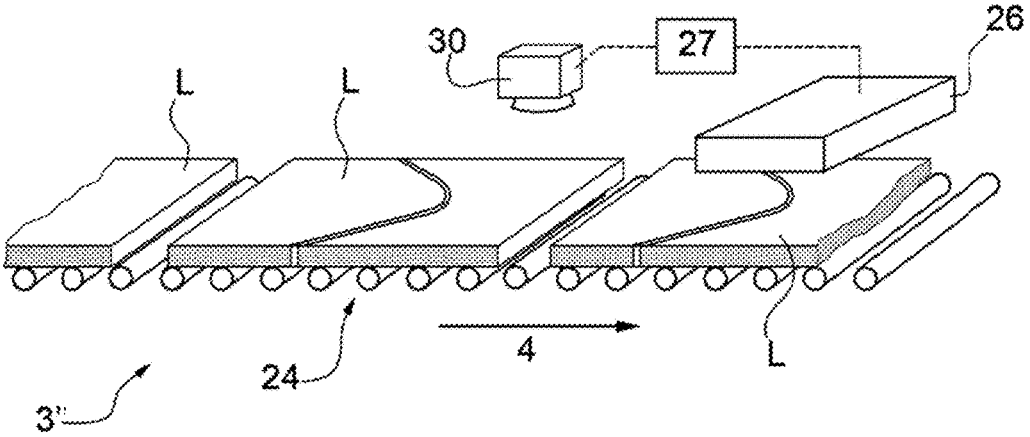
FIG. 2 is a schematic perspective view of a portion of the plant of FIG. 1.
Figure 3:
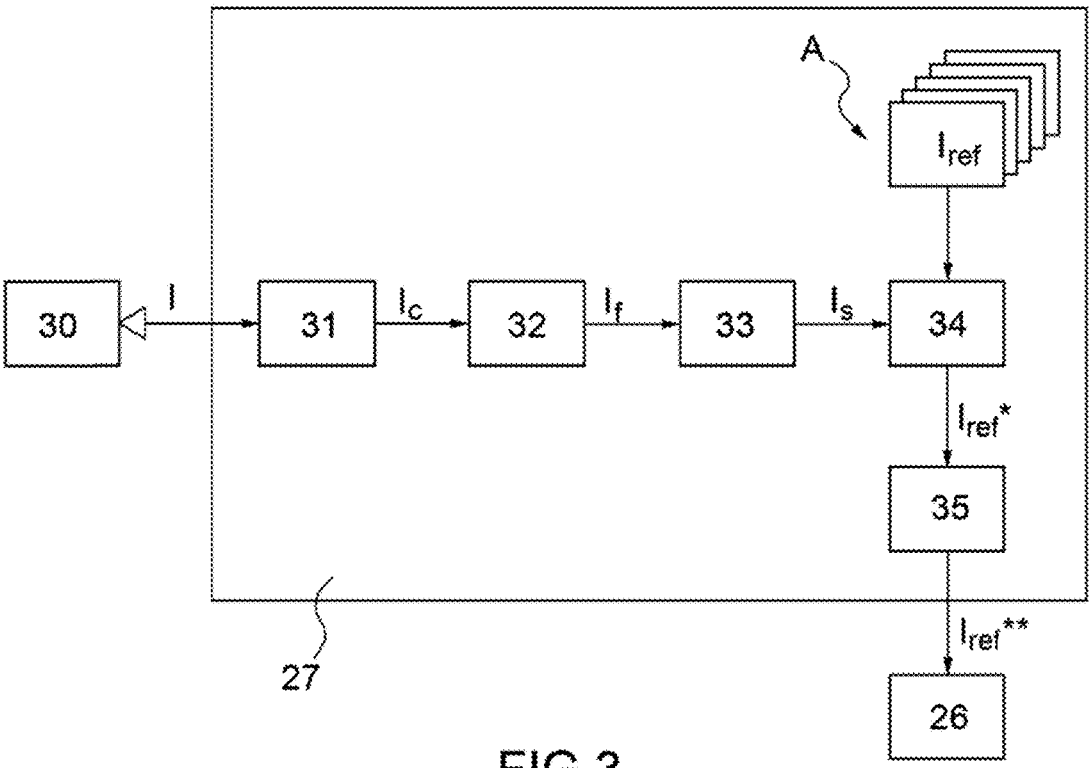
FIG. 3 is a block diagram illustrating some steps of the method for manufacturing ceramic products implemented in accordance with the present invention.
Figure 4:
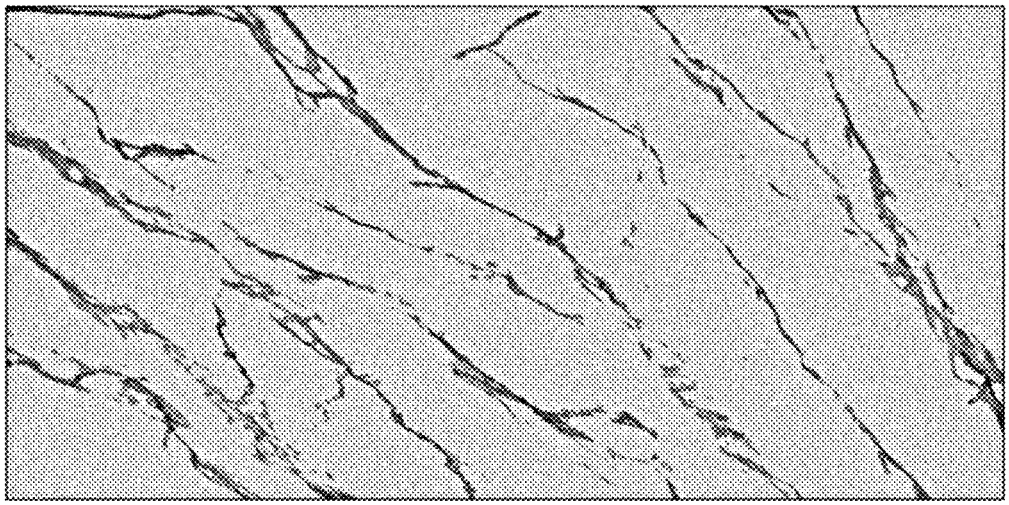
FIGS. 4 to 9 represent in sequence the steps of the method of implementation of FIG. 3.

According to what is illustrated in FIGS. 2 and 3, the printing device 26 comprises an optical detection device 30 connected to the processing unit 27; the optical detection device 30 is arranged over the roller conveyor 24 and designed to acquire the surface image I of each slab L. In particular, the optical detection device 30 is designed to acquire a surface image I of the compacted powder layer CPL (in particular, of each slab L) that reproduces the surface chromatic effects obtained in the slabs L. According to a preferred variant, the optical detection device 30 is a digital camera 30 with grayscale scan line. The optical detection device 30 transmits the surface images I to the processing unit 27.

Figure 5:
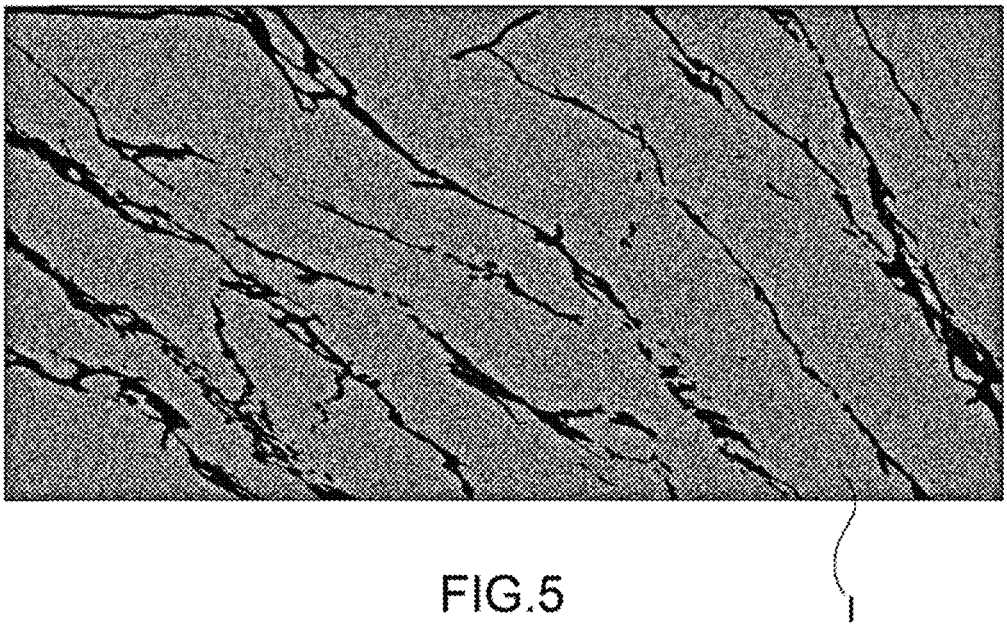

More precisely, but not necessarily, according to what is better illustrated in FIG. 3, the processing unit 27 receives at the input the individual surface images I, which it processes graphically to create a graphic decoration on the single slabs L coordinated with the chromatic effects obtained in the thickness of the same slabs L. The surface image I acquired by the optical detection device 30 is illustrated in FIG. 5.

In particular, the surface image I of each slab L is transmitted as input to a block 31 that processes it so as to increase the contrast. In other words, inside the block 31, the contrast between the surface chromatic effects (such as veins or streaks) of the slab L and the background of the same slab L is highlighted. Advantageously, but not necessarily, the surface image $I_c$ output from the block 31 is transmitted to the input of a filter block 32.

Figure 6:
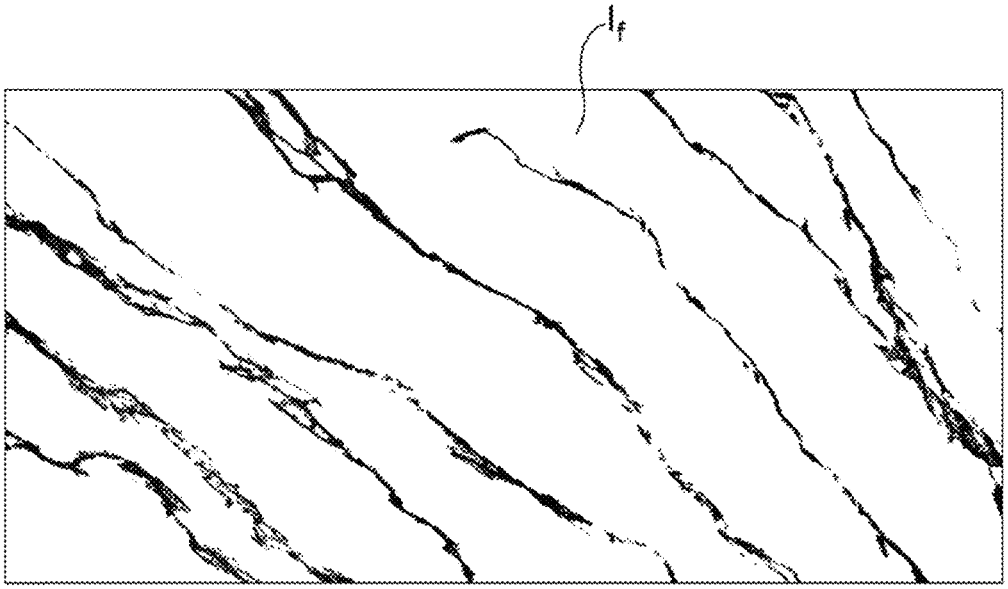

Inside the filter block 32, a filter is applied to the surface image $I_c$ to remove any background noise present in the surface image $I_c$. According to a preferred variant, a low-pass filter is applied to eliminate sudden luminance transitions, for example generated by any isolated pixels or by surface chromatic effects (such as veins or streaks) of minor importance. The filtered surface image $I_f$ is illustrated in FIG. 6.

According to some advantageous but non-limiting embodiments, the filtered surface image $I_f$ is then transmitted as input to a block 33 that processes it to identify the most significant trajectories T of the surface chromatic effects. The filtered surface image $I_f$ is processed through known operators for graphic image processing; typically, said operators allow the individual pixels not to be considered but rather a vector of pixels of given dimensions to be considered. In other words, said operators for graphic image processing allow a pixel to be modified as a function of the values of a set of pixels in a region of limited dimensions that surround it so as to highlight the most significant trajectories T of the surface chromatic effects.

Figure 7:
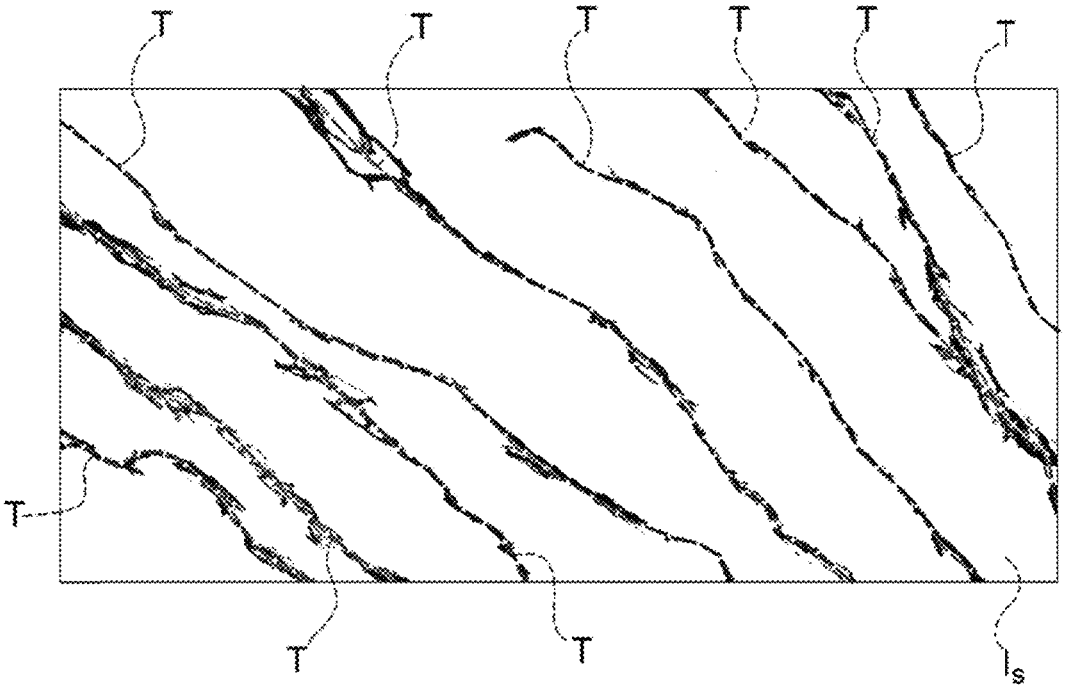

The processed surface image $I_s$ is illustrated in FIG. 7, wherein each trajectory T is associated with a particular surface chromatic effect (such as a vein).

Advantageously, but not necessarily, an archive A of reference images $I_{ref}$, each of which reproduces given surface chromatic effects, is stored inside the processing unit 27. In other words, each reference image $I_{ref}$ is provided with a combination of streaks and veins different from one another with regard to number and surface distribution. The reference images $I_{re}$f are stored inside the archive A in a preliminary development step.

The processed surface image $I_s$ is transmitted as input to a comparison block 34 inside which the processed surface image $I_s$ is compared with the reference images $I_{ref}$ contained inside the archive A.

At the end of the comparison step between the processed surface image $I_s$ and the reference images $I_{ref}$, the processing unit 27 is arranged to identify the reference image $I_{ref}$* most similar to the processed surface image $I_s$ from those available. In particular, the processing unit 27 is configured to recognize the reference image $I_{ref}$* in which the surface chromatic effect is closest to the set of trajectories T.

The selection of the reference image $I_{ref}$* in which the surface chromatic effect is closest to the set of trajectories T among those available is implemented as a function of some parameters, such as the shape of the trajectories T (rectilinear, curved, uniform, variable, rounded, elongated, etc.), the dimension of the trajectories T (small, large, concentrated, spread out, etc.), the effect on the edge of the slab L (well-defined, blurred, etc.) and the type of trajectories T (single vein, stratification, etc.).

Figure 9:
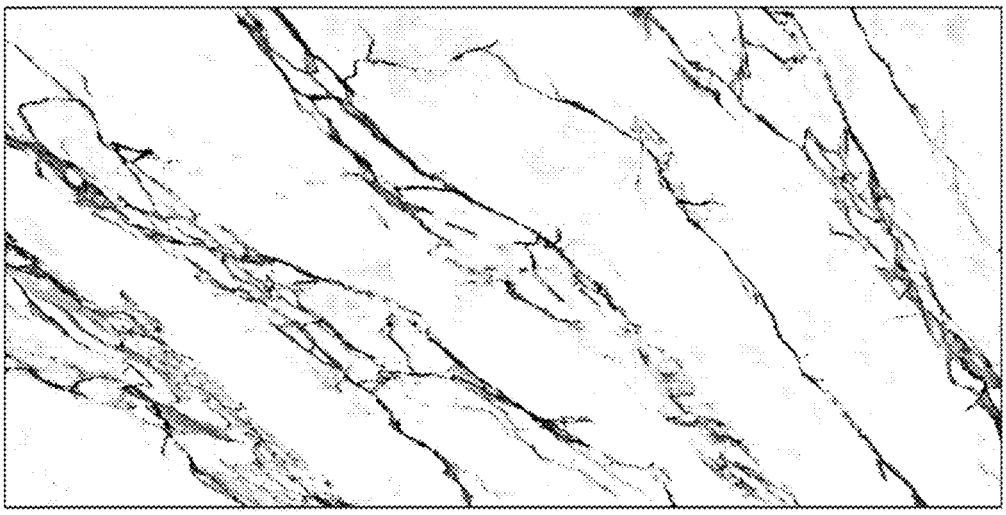

According to a first non-limiting embodiment, the processing unit 27 subsequently proceeds to prepare the graphic decoration to be applied on the slab L illustrated in FIG. 9 by adapting the reference image $I_{ref}$* further processed with the resolution and depth of colour desired, which is then printed on the slab L by the printing device 26.

In particular, the step of preparing the graphic decoration to be applied on the slab L entails modifying and deforming the reference image $I_{ref}$* (for example, through lengthening/shortening in the various directions of the plane, deformation/variation of the shape, rotation and flipping, etc.) so as to simultaneously satisfy the need to avoid excessive distortion of the reference image $I_{ref}$* and, at the same time, to remain as close as possible to the processed surface image $I_s$.

According to a second non-limiting embodiment, the processing unit 27 proceeds to prepare the graphic decoration to be applied on the slab L adapting the reference image $I_{ref}$* with the resolution and the colour depth desired, only in the case in which the reference image $I_{ref}$* satisfies the criteria of resemblance to the processed surface image $I_s$ (that is, the reference image $I_{ref}$* is sufficiently similar to the processed surface image $I_s$).

In the case in which the reference image $I_{ref}$* does not satisfy the criteria of resemblance to the processed surface image $I_s$ (that is, the reference image $I_{ref}$* is not sufficiently similar to the processed surface image $I_s$), the processing unit 27 is arranged to implement inside the block 35 a further step of graphic adaptation of the reference image $I_{ref}$* to the processed surface image $I_s$.

Figure 8:
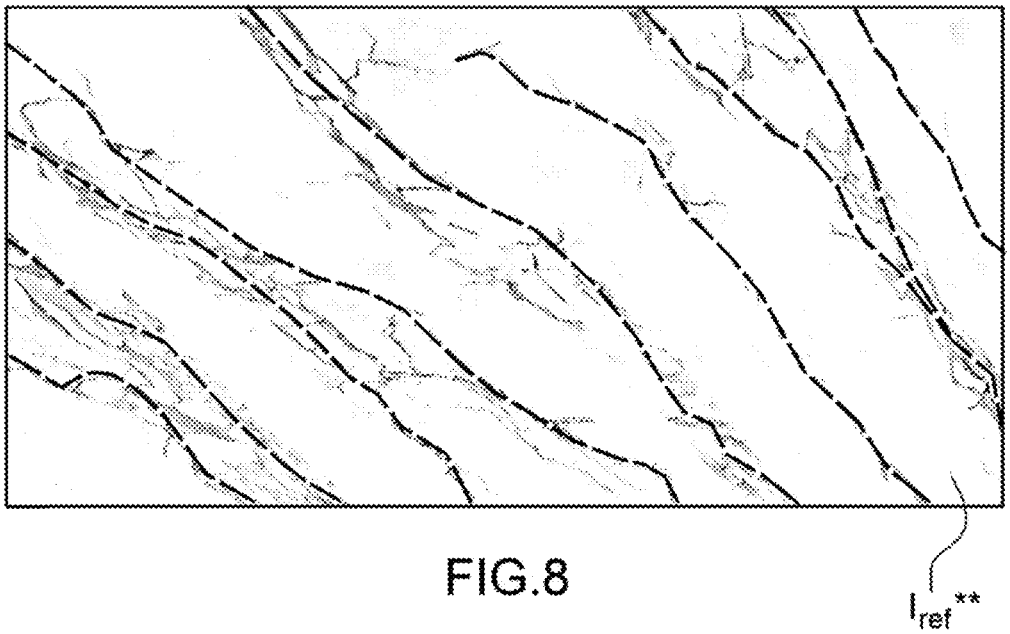

Typically, the step of graphic adaptation is implemented through known graphic processing techniques, such as stretching and morphing, through which the reference image $I_{ref}$* is transformed to converge towards the processed surface image $I_s$ respecting the topology of the set of trajectories T. A reference image $I_{ref}$ further processed and obtained by means of known graphic processing techniques, such as stretching and morphing, is illustrated in FIG. 8**.

The processing unit 27 then proceeds to prepare the graphic decoration to be applied on the slab L adapting the reference image $I_{ref}$ with the resolution and the colour depth desired, which is then printed on the slab L by the printing device 26**.

Compared to the first embodiment, this second embodiment allows improvement, when necessary, of the synchronization between the chromatic effects in the thickness of the slab L and the graphic decoration applied on the surface of the slab L.

According to a third and preferred non-limiting embodiment, the processing unit 27 is arranged to implement, in any case, a graphic adaptation of the reference image $I_{ref}$* to the processed surface image $I_s$.

Also in this case the step of graphic adaptation is implemented through known graphic processing techniques, such as stretching and morphing, through which the reference image $I_{ref}$* is transformed to converge towards the processed surface image $I_s$. The processing unit 27 prepares the graphic decoration to be applied on the slab L adapting the reference image $I_{ref}$ with the resolution and the colour depth desired. The graphic decoration is then printed on the surface of the slab L by the printing device 26**. Advantageously, this third embodiment allows the best possible synchronization between the chromatic effects in the thickness of the slab L and the graphic decoration applied on the surface of the slab L to be obtained.

The first embodiment described above allows, if compared with the further embodiments described, a reduction in the processing times and, consequently, an increase in hourly productivity.

The graphic processing technique known as morphing is described, for example, in the article by Biancolini M. E., Salvini P. entitled "*Radial Basis Functions for the image analysis of deformations", Computational Modelling of Objects Represented in Images,* 2012, Taylor & Francis Group, London, incorporated herein by reference.

Other useful indications for performing the activity of image adaptation (and hence also morphing) are contained in the following scientific articles, each of which is incorporated herein by reference:

Amodio D., Broggiato G. B., Salvini P., "Finite Strain Analysis by Image Processing: Smoothing Techniques", Strain, Vol. 31, n. 3, 1995, pp. 151-157;

N. Arad, N. Dyn, D. Reisfeld, Y. Yeshurun, "Image warping by radial basis functions: application to facial expressions", CVGIP: Graphical Models and Image Processing, 56 (1994), pp. 161-172;

G. Besnard•F. Hild•S. Roux, "Finite-Element" Displacement Fields Analysis; from Digital Images: Application to Portevin-Le Châtelier Bands, Experimental Mechanics (2006) 46: 789-80;

Biancolini, M. E., "Mesh Morphing and Smoothing by Means of Radial Basis Functions (RBF): A Practical Example Using Fluent and RBF Morph" in Handbook of Research on Computational Science and Engineering: Theory and Practice, IGI Global, ISBN13: 9781613501160;

J. Flusser, T. Suk, B. Zitová, Moments and Moment Invariants in Pattern Recognition, John Wiley & Sons, (2009).

Minotti M., Marotta E., Salvini P., "Determinazione del campo di grandi spostamenti tramite l'elaborazione di immagini digitali", Atti Convegno XL AIAS, 7-10 Settembre, Palermo, 2011;

Sutton M. A., Orteu J. J., Shreier H. W., "Image Correlation for Shape, Motion and Deformation Measurements", ISBN 0387787461, Springer, 2009;

Sutton M. A., Turner J. L., Chao Y. J., Bruch A., Chae T. L., "Full field representation of discretely sampled surface deformation for displacement and strain analysis. Experimental Mechanics, 31 (2): 168-177, 1991;

J. Torres, J. M. Menéndez, "A Practical algorithm to correct geometrical distortion of image acquisition cameras", International Conference on Image Processing, Singapore, 2004.

According to a preferred variant, before printing the graphic decoration, a base coat of enamel is applied on the upper surface of the slab L.

According to a further embodiment, the cutting device 21 is arranged downstream of the printing device and the optical detection device 30 is designed to acquire a surface image I of the compacted powder layer CPL (in particular, of a portion of the compacted powder layer CPL) that reproduces the respective surface chromatic effects, rather than a surface image I of the individual slabs L.

According to some non-limiting embodiments, where the ceramic powders do not have sufficiently marked differences in colour before firing, it is possible to provide the powders with organic dyes (such as methylene blue) visible to the naked eye and/or a particular wavelength so as to facilitate the activity of the device 30. Typically, these dyes are then burned and eliminated during the firing step.

Unless specifically indicated to the contrary, the content of the references (articles, books, patent applications, etc) cited in this text is fully incorporated herein. In particular, the references mentioned are incorporated herein by reference.

The plant 1 and the method for manufacturing ceramic products C described above have the advantage of obtaining perfect synchronization between the chromatic effect obtained in the thickness of the slab L and the surface graphic decorations that are applied on the same slab L by means of digital printing allowing a finished ceramic product C very similar to the natural product to be obtained.

We claim:

1. A method for manufacturing ceramic products comprising;

a feeding step to feed a mixture of at least two ceramic powders having different features and/or colours from one another so as to obtain a powder material strip;

a compacting step to compact the powder material strip so as to obtain a compacted powder layer provided with respective surface chromatic effects and with respective chromatic effects in the thickness;

a printing step to create a graphic decoration on the surface of the compacted powder layer so as to make the compacted powder layer more similar to a natural product;

the printing step comprises the further steps of:

acquiring a surface image of the compacted powder layer, which reproduces the respective surface chromatic effects;

processing said surface image so as to obtain the graphic decoration to be applied on the surface of the compacted powder layer, which is coordinated with the respective chromatic effects in the thickness; and printing the graphic decoration on the surface of the compacted powder layer the method comprising the further steps of:

identifying a reference image of the surface image of the compacted powder layer within an archive, where a plurality of reference images are stored, each of the reference images reproducing given surface chromatic effects; and processing the reference image so as to obtain the graphic decoration to be applied on the surface of the compacted powder layer, wherein the step of identifying a reference image of the surface image of the compacted powder layer comprises the further steps of;

processing the surface image of the compacted powder layer so as to identify the trajectories of the most significant surface chromatic effects to be compared with the reference images contained in said archive; and identifying, among the reference images contained in said archive, the one that is the most similar to the surface image of the compacted powder layer.

2. A method according to claim 1, further comprising the step of:

processing the reference image by means of graphic processing means so as to obtain the graphic decoration to be applied on the surface of the compacted powder layer.

3. A method according to claim 1, prior to the step of processing in order to identify the trajectories of the most significant surface chromatic effects, the method further comprising the step of:

filtering the surface image of the compacted powder layer so as to remove the possibly present background noise.

4. A method according to claim 3, prior to the filtering step, the method further comprising the step of:

processing the surface image so as to increase the contrast between the surface chromatic effects and a background of the compacted powder layer.

5. A method according to claim 1, further comprising the step of:

applying a covering primer enamel on the surface of the compacted powder layer before printing the graphic decoration on said surface.

6. A method according to claim 1, further comprising a separation step of:

separating the compacted powder layer into single slabs, each provided with respective surface chromatic effects and with respective chromatic effects in the thickness.

7. A method according to claim 6, wherein the separation step is prior to the printing step.

8. A system for manufacturing ceramic products comprising:

a feeding assembly to feed a mixture containing at least two ceramic powders having different features and/or colours from one another so as to obtain a powder material strip (CP);

a pressing unit to press the powder material strip, which is arranged downstream of the feeding assembly so as to obtain a compacted powder layer provided with respective surface chromatic effects and with respective chromatic effects in the thickness; and a printing device, which is designed to create a graphic decoration on the surface of the compacted powder layer to thereby make the compacted powder layer more similar to a natural product;

wherein the system comprises an optical detection device, which is arranged upstream of the printing device and is designed to acquire a surface image of the compacted powder layer, which reproduces the respective surface chromatic effects; and a processing unit, which receives the surface images of the compacted powder layer from the optical detection device and processes them so as to obtain the graphic decoration to be transmitted to the printing device, the processing unit further:

identifying a reference image of the surface image of the compacted powder layer within an archive, where a plurality of reference images are stored, each of the reference images reproducing given surface chromatic effects; and processing the reference image so as to obtain the graphic decoration to be applied on the surface of the compacted powder layer, wherein the step of identifying a reference image of the surface image of the compacted powder layer comprises the further steps of:

processing the surface image of the compacted powder layer so as to identify the trajectories of the most significant surface chromatic effects to be compared with the reference images contained in said archive; and identifying, among the reference images contained in said archive, the one that is the most similar to the surface image of the compacted powder layer, wherein the graphic decoration is coordinated with the respective chromatic effects in the thickness of the compacted powder layer.

9. The system according to claim 8, wherein the optical detection device comprises a digital camera with a grayscale scan line.

10. The system according to claim 8, further comprising:

a cutting device, wherein:

the cutting device is designed to separate the compacted powder layer into single slabs; and each slab is provided with respective surface chromatic effects and with respective chromatic effects in the thickness.

11. The system according to claim 10, wherein the optical detection device is interposed between the cutting device and the printing device.

* * * * *